US008162442B2

(12) United States Patent
Kameyama et al.

(10) Patent No.: US 8,162,442 B2
(45) Date of Patent: Apr. 24, 2012

(54) RECORDING APPARATUS

(75) Inventors: Fumie Kameyama, Kawasaki (JP); Motoyuki Taguchi, Kawasaki (JP); Akira Kida, Yokohama (JP); Nozomu Nishiberi, Yokohama (JP); Noriyuki Sugiyama, Kawasaki (JP); Masayuki Imano, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 741 days.

(21) Appl. No.: 12/324,141

(22) Filed: Nov. 26, 2008

(65) Prior Publication Data

US 2009/0141098 A1 Jun. 4, 2009

(30) Foreign Application Priority Data

Nov. 29, 2007 (JP) ..... 2007-308589

(51) Int. Cl.
*B41J 2/16* (2006.01)

(52) U.S. Cl. ..... 347/49

(58) Field of Classification Search ..... 347/49, 347/50, 85, 86
See application file for complete search history.

(56) References Cited

U.S. PATENT DOCUMENTS

| | | | | |
|---|---|---|---|---|
| 6,550,902 | B2 * | 4/2003 | Shinada et al. | 347/86 |
| 6,554,412 | B1 * | 4/2003 | Seino et al. | 347/86 |
| 6,755,515 | B2 * | 6/2004 | Usui et al. | 347/86 |
| 7,008,053 | B2 * | 3/2006 | Hashii et al. | 347/86 |
| 2007/0268344 | A1 | 11/2007 | Anderson et al. | |

FOREIGN PATENT DOCUMENTS

| | | |
|---|---|---|
| EP | 469536 | 2/1992 |
| EP | 1857285 | 11/2007 |
| JP | 2004-90343 | 3/2004 |

* cited by examiner

*Primary Examiner* — Anh T. N. Vo
(74) *Attorney, Agent, or Firm* — Canon USA Inc IP Division

(57) ABSTRACT

A recording apparatus includes a head set lever which fixes a head cartridge to a carriage section. The head set lever is movable between a first position at which the head cartridge is fixed to the carriage section and a second position at which mounting and removal of the head cartridge on and from the carriage section is permitted. Attachment of an ink tank to the head cartridge is inhibited when the head cartridge is mounted on the carriage section and the head set lever is arranged at a position other than the first position.

7 Claims, 16 Drawing Sheets

RECORDING APPARATUS

BACKGROUND OF THE INVENTION

1. Field of the Invention

The present invention relates to a recording apparatus which performs recording on recording media.

2. Description of the Related Art

Recording apparatuses include recording apparatuses serving as, for example, a printer, a copier, and a facsimile, and recording apparatuses used as, for example, a multi-function electronic device such as a computer or a word processor, and an output device such as a workstation. These apparatuses each have a configuration in which an image is recorded on a recording member (recording medium), such as a recording sheet or a plastic thin plate, in accordance with image information. Such recording apparatuses may be grouped, in accordance with the recording type, into inkjet type, wire-dot type, thermal type, laser-beam type, and the like.

Nowadays, in particular, the inkjet type is widely known for home use because the inkjet type achieves high-quality image recording and low running costs. It is desirable that recording apparatuses such as these be reduced in size and weight, and to be increased in efficiency of operation and maintenance. An inkjet recording apparatus of serial scan type, in which a head cartridge and an ink tank is configured as a cartridge removably mounted on an apparatus body, is increased in efficiency of maintenance. Thus, this type of inkjet recording apparatus is widely used in low-cost general-purpose printers for home use.

Japanese Patent Laid-Open No. 2004-90343 discloses a serial-scan inkjet recording apparatus in which a head cartridge and an ink tank are removably mounted on a carriage. The carriage has a lever which is operated when the head cartridge is mounted or removed. In the recording apparatus, the head cartridge is mounted on the carriage, and then the lever is operated in one direction, so that the head cartridge is fixed to the carriage. Then, the ink tank is mounted on the carriage.

In the above related configuration, the ink tank has to be mounted on the carriage after the carriage is inserted into the head cartridge and the head cartridge is fixed by the mounting-and-removal operation lever. However, with this configuration, a user may mount the ink tank on the carriage before the head cartridge is fixed. Thus, defective mounting may be performed as a result of such an incorrect operation procedure.

SUMMARY OF THE INVENTION

The present invention provides a recording apparatus capable of preventing a user from defectively mounting a head cartridge and an ink tank on a carriage as a result of an incorrect procedure.

According to an aspect of the present invention, a recording apparatus is provided which includes a carriage including a head cartridge configured to perform recording on a recording medium, the carriage being configured to removably mount the head cartridge thereon, the head cartridge including a recording head and an ink tank, the head cartridge being configured to detachably attach the ink tank thereto, the ink tank being configured to contain ink; and a fixing unit configured to fix the head cartridge to the carriage, the fixing unit being movable between a first position at which the head cartridge is fixed to the carriage and a second position at which mounting and removal of the head cartridge on and from the carriage is permitted. The attachment of the ink tank to the head cartridge is inhibited when the head cartridge is mounted on the carriage and the fixing unit is arranged at a position other than the first position.

Further features of the present invention will become apparent from the following description of exemplary embodiments with reference to the attached drawings.

DESCRIPTION OF THE EMBODIMENT

An embodiment of the present invention is described below with reference to the attached drawings.

First Embodiment

Figure 1:
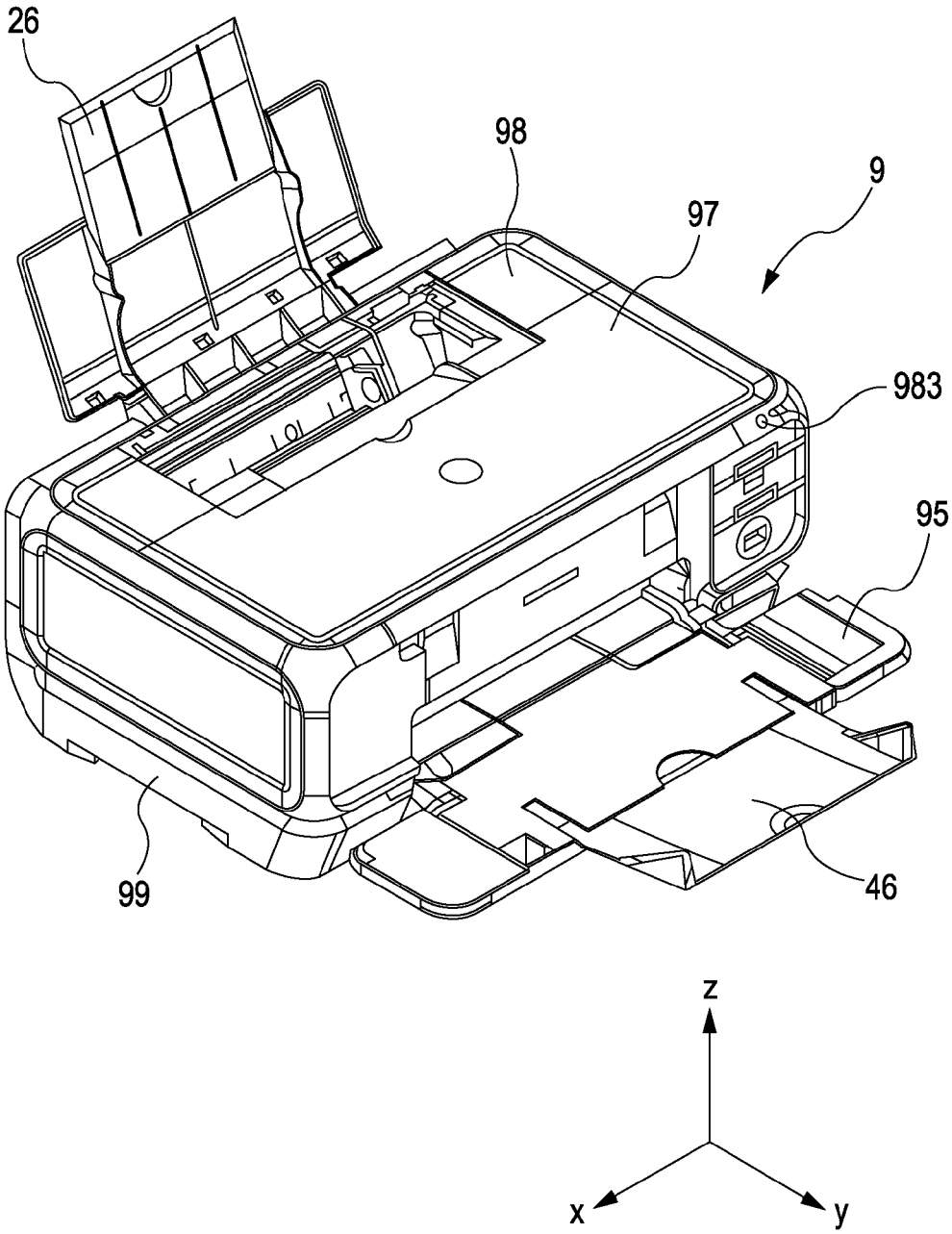
FIG. 1 is a perspective view showing a recording apparatus according to a first embodiment of the present invention.
Figure 2:
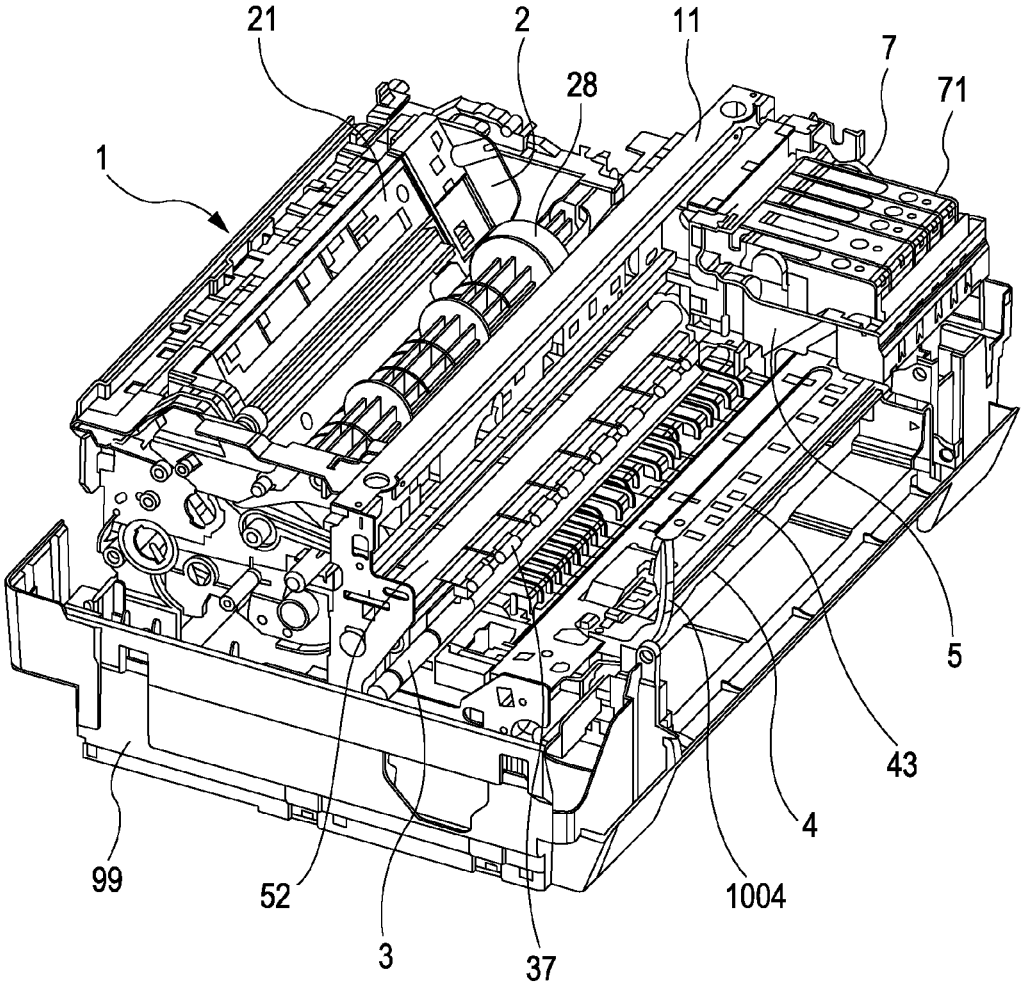
FIG. 2 is a perspective view showing a mechanical unit of the recording apparatus shown in FIG. 1.
Figure 3:
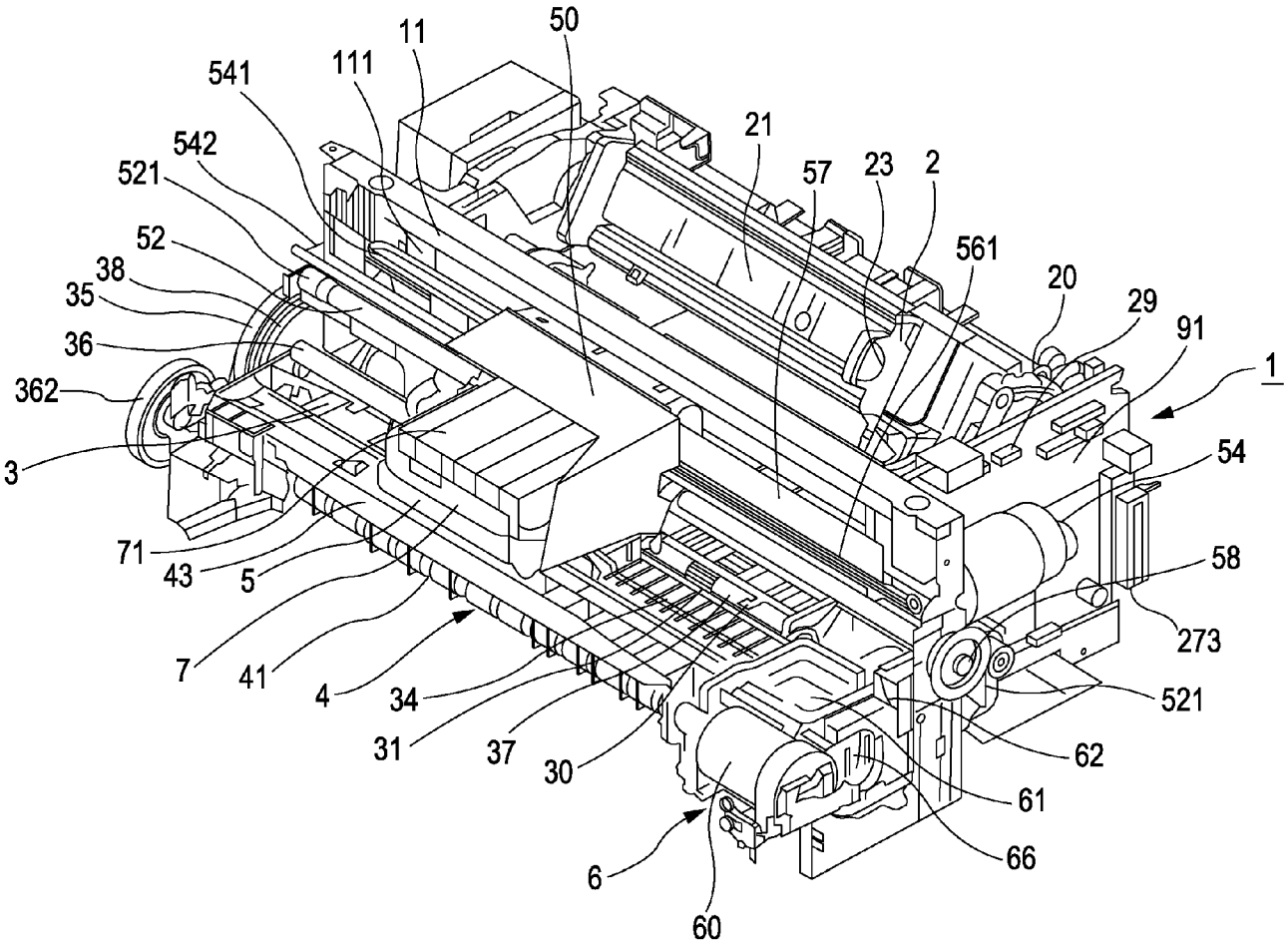
FIG. 3 is a perspective view showing the mechanical unit of the recording apparatus shown in, for example, FIG. 1.
Figure 4:
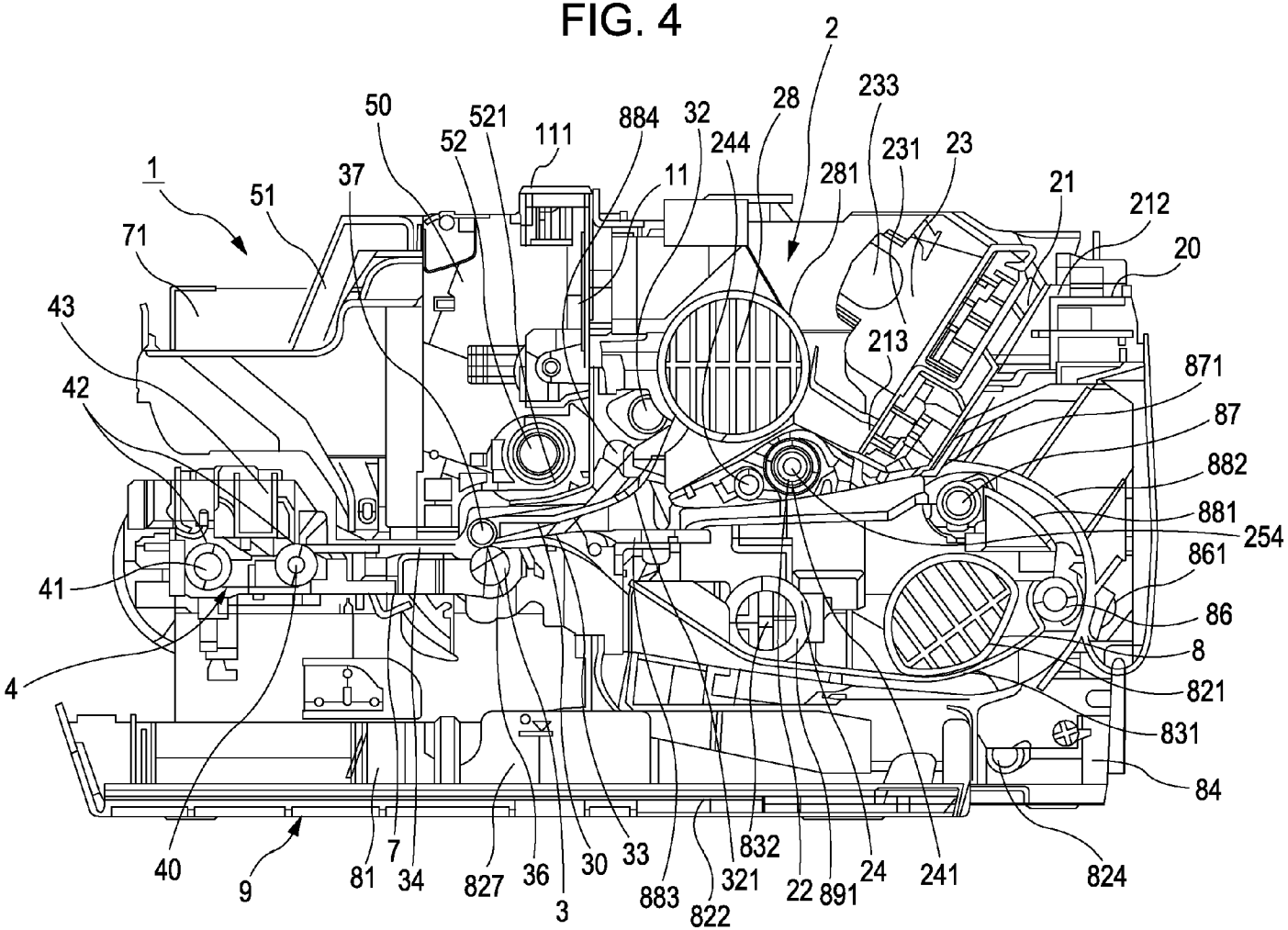
FIG. 4 is a cross-sectional view showing the recording apparatus shown in, for example, FIG. 1.

FIG. 1 is a perspective view showing a recording apparatus 1 according to a first embodiment of the present invention. FIGS. 2 and 3 are perspective views each showing a mechanical unit of the recording apparatus 1. FIG. 4 is a cross-sectional view showing the recording apparatus 1.

The recording apparatus 1 of this embodiment includes a paper feed section 2, a conveyance section 3, a paper ejection section 4, a carriage section 5, a recovery section 6 (shown in FIG. 3), a head cartridge 7, a U-turn automatic both-side conveyance section 8 (shown in FIG. 4), and a cover section 9. Referring to FIGS. 1 to 4, general configurations of these sections are successively described.

(A) Paper Feed Section

The paper feed section 2 includes, for example, a pressure plate 21 on which recording sheets (not shown) are stacked, a paper feeding roller 28 which feeds a recording sheet, a separating roller 241 which separates a recording sheet, and a return lever 22 which causes a recording sheet to return to a stacked position. These components are attached to a base 20.

A paper feed tray 26 is attached to the base 20 or the cover section 9. The paper feed tray 26 holds the stacked recording sheets. The paper feed tray 26 is housed in a folding manner. The paper feed tray 26 is drawn out when it is used.

The paper feeding roller 28 is formed into a rod-like shape having an arc cross section. A paper feeding roller rubber piece is provided near a sheet reference, and hence, a recording sheet is fed. The paper feeding roller 28 is rotated by a driving force which is transmitted from a motor (hereinafter, referred to as AP motor) 273 through a transmission gear (not shown) and a planet gear (not shown). The AP motor 273 is provided at the paper feed section 2, and is shared by the recovery section 6.

A movable side guide 23 is movably provided at the pressure plate 21. The movable side guide 23 regulates the stacked position of the recording sheets. The pressure plate 21 is rotatable around a rotation shaft which is supported by the base 20. The pressure plate 21 is biased towards the paper feeding roller 28 by a pressure plate spring 212. A separation sheet 213 is provided at a portion of the pressure plate 21, the portion facing the paper feeding roller 28. The separation sheet 213 is made of a material having a large friction coefficient, and thus prevents double feeding of stacked recording sheets. The pressure plate 21 is configured to contact or be separated from the paper feeding roller 28 by a pressure plate cam (not shown).

The separating roller 241 which separates recording sheets one by one is attached to a separating roller holder 24. The separating roller holder 24 is mounted on the base 20. The separating roller holder 24 is rotatable around a rotation shaft supported by the base 20. The separating roller holder 24 is biased towards the paper feeding roller 28 by a separating roller spring (not shown). A clutch spring (not shown) is attached to the separating roller 241. When a predetermined or higher load is applied to the clutch spring, a portion thereof to which the separating roller 241 is attached is rotated. The separating roller 241 is configured to contact or be separated from the paper feeding roller 28 by a separating roller release shaft 244 and a control cam (not shown). An automatic sheet feeding (ASF) sensor 29 detects the positions of the pressure plate 21, the return lever 22, and the separating roller 241.

Also, the return lever 22, which causes the recording sheet to return to the stacked position, is rotatably attached to the base 20. The return lever 22 is biased in a release direction by a return lever spring (not shown). When the recording sheet returns, the return lever 22 is rotated by the control cam.

In a standby state, the pressure plate 21 is released by the pressure plate cam, and the separating roller 241 is released by the control cam. At this time, the return lever 22 causes the recording sheet to return to the stacked position, and is arranged at a position to close a stacking port so that the stacked recording sheets are not fed to the paper feeding roller 28.

When the operation of the paper feed section 2 is started, firstly, the separating roller 241 contacts the paper feeding roller 28 by the driving force of the motor, secondly, the return lever 22 is released, and the pressure plate 21 contacts the paper feeding roller 28. In this state, feeding of the recording sheet is started. The number of recording sheets to be fed to a separation portion (not shown) arranged at the base 20 is regulated. Recording sheets are fed by a predetermined piece number to a nip portion which is defined by the paper feeding roller 28 and the separating roller 241. The recording sheets by the predetermined piece number are separated at the nip portion, and hence, only a top recording sheet is conveyed by the paper feeding roller 28.

When the recording sheet reaches a roller pair including a conveying roller 36 and a pinch roller 37, which will be described later, the pressure plate 21 is released by the pressure plate cam, and the paper feeding roller 28 is released by the control cam. The return lever 22 returns to the stacked position of the recording sheets by the control cam. The recording sheets separated at the nip portion, which is defined by the paper feeding roller 28 and the separating roller 241, return to the stacked position.

(B) Conveyance Section

The conveyance section 3 is attached to a chassis 11 formed of a molded product of plate metal. The conveyance section 3 includes, for example, the conveying roller 36 which conveys a recording sheet, and a PE sensor (not shown) which detects a recording sheet. The conveying roller 36 is a metal shaft with a surface thereof being coated with ceramic fine particles. The conveying roller 36 is attached to the chassis 11 such that metal portions at both ends of the shaft are supported by bearings 38. A conveying roller tension spring (not shown) is provided between each of the bearings 38 and the conveying roller 36. When the conveying roller tension spring biases the conveying roller 36, a predetermined load is applied to the conveying roller 36. When the load is applied, the conveying roller 36 provides stable conveyance during rotation.

A plurality of driven pinch rollers 37 are arranged at the conveying roller 36 in a contact manner. The pinch rollers 37 are held by a pinch roller holder 30. When the pinch rollers 37 are biased towards the conveying roller 36 by a pinch roller spring 31, a recording sheet can be pinched between the conveying roller 36 and the pinch rollers 37. The rotation shaft of the pinch roller holder 30 is supported by bearings formed at the chassis 11. When a recording sheet is conveyed, the pinch roller holder 30 is rotated around the rotation shaft in synchronization with the conveyance of the recording sheet. A paper guide flapper 33 and a platen 34 are provided at an entrance of the conveyance section 3 to which the recording sheet is conveyed from the paper feed section 2. The paper guide flapper 33 and the platen 34 guide the recording sheet. The paper guide flapper 33 is arranged to contact the chassis 11, and is fitted to the conveying roller 36. When the rotation shaft of the paper guide flapper 33 slides on the bearings of the conveying roller 36, the paper guide flapper 33 can be rotated around the rotation shaft. Also, a PE sensor lever 321 is provided at the pinch roller holder 30. The PE sensor lever 321 transmits detection of a front edge or a rear edge of the recording sheet to the PE sensor.

In the above-described configuration, the recording sheet fed to the conveyance section 3 is guided by the pinch roller holder 30 and the paper guide flapper 33, and is fed to the roller pair including the conveying roller 36 and the pinch rollers 37. At this time, the PE sensor detects the front edge of the recording sheet which is conveyed to the PE sensor lever 321. With the detection, a recording position of the recording sheet is determined. A rib is formed on the platen 34. The rib defines a gap between the recording sheet to be conveyed and the head cartridge 7. When the roller pair including the conveying roller 36 and the pinch rollers 37 is rotated by a driving force of a conveyance motor 35, the recording sheet is conveyed along the rib on the platen 34 as a reference surface. Also, the rib is formed so that the recording sheet is prevented from being ruffled.

The conveying roller 36 is driven when a torque of the conveyance motor 35, which is a DC motor, is transmitted to a pulley (not shown) provided on the shaft of the conveying roller 36, through a timing belt (not shown). Also, a code wheel (not shown) having marking at a pitch ranging from 150 to 300 lines per inch (lpi) (i.e. 6 to 12 lines per mm) is provided on the rotation shaft of the conveying roller 36, for detection of a conveying amount by the conveying roller 36. Also, an encoder sensor (not shown) is attached to the chassis 11 at a position near the code wheel. The encoder sensor reads the conveying amount detected by the code wheel.

The head cartridge 7 is provided downstream of the conveying roller 36 in a recording sheet conveying direction. The head cartridge 7 forms an image on a recording sheet in accordance with image information. The head cartridge 7 includes an inkjet recording head, to which ink tanks for respective colors can be detachably attached. The head cartridge 7 can apply heat to ink filled in an ink flow path (not shown) by using, for example, a heater (not shown). The heat causes film boiling of the ink. The film boiling causes air bubbles to be expanded or contracted, resulting in a pressure change. The pressure change causes the ink to be ejected from a nozzle (not shown) of the head cartridge 7, and accordingly, an image is formed on the recording sheet.

(C) Carriage Section

The carriage section 5 includes, for example, a carriage 50 to which the head cartridge 7 is mounted. The carriage 50 is supported by a guide shaft 52 for reciprocation scanning of the carriage 50 in a direction orthogonal to the recording sheet conveying direction, and a guide rail 111 which holds a rear end of the carriage 50 to keep a gap between the head cartridge 7 and the recording sheet. The guide shaft 52 is attached to the chassis 11. The guide rail 111 is integrally formed with the chassis 11.

Also, the carriage 50 is driven by a driving force of a carriage motor 54, which is attached to the chassis 11. The driving force is transmitted through a timing belt 541 stretched and supported by an idle pulley 542. The timing belt 541 is coupled to the carriage 50 with a carriage damper (not shown) made of, for example, rubber interposed therebetween. The carriage damper attenuates vibration caused by the carriage motor 54 and other components, and hence, reduces, for example, image unevenness which is expected to appear in a recorded image on a recording sheet due to the vibration.

A code strip 561 (FIG. 3) having marking at a pitch ranging from 150 to 300 lpi (i.e. 6 to 12 lines per mm) is provided in parallel to the timing belt 541, for detection of the position of the carriage 50. Also, an encoder sensor (not shown) is provided at a carriage substrate (not shown) which is mounted on the carriage 50. The encoder sensor reads the marking. A contact (not shown) is provided at the carriage substrate, so as to provide electric connection between the carriage substrate and the head cartridge 7. Also, the carriage 50 is provided with a flexible substrate (not shown) for transmitting a signal from the carriage substrate to the head cartridge 7.

In addition, eccentric cams 521 are provided at both ends of the guide shaft 52. When the driving force of the carriage motor 54 is transmitted to the eccentric cams 521 via a gear train (not shown), the eccentric cams 521 can vertically lift or lower the guide shaft 52. When the guide shaft 52 is lifted or lowered, the carriage 50 supported by the guide shaft 52 is lifted or lowered accordingly. Thus, the carriage 50 can be arranged at an optimum height even when recording sheets with different thicknesses are used.

Further, an automatic registration adjustment sensor (not shown) is attached to the carriage 50. The automatic registration adjustment sensor automatically corrects a landing deviation of ink ejected from the head cartridge 7, onto a recording sheet. The automatic registration adjustment sensor is a reflection optical sensor. The sensor detects light, which is generated from a light-emitting element, and is reflected by a predetermined recording pattern provided on the recording sheet, thereby obtaining an optimum registration adjustment value.

In the above-described configuration, the recording sheet is conveyed by the roller pair including the conveying roller 36 and the pinch rollers 37 to a line position (a position in the recording sheet conveying direction) to form an image on the recording sheet. At the same time, the carriage 50 is moved by the carriage motor 54 to a row position (a position orthogonal to the recording sheet conveying direction) for the image formation. Accordingly, the head cartridge 7 faces an image formation position of the recording sheet. In this state, the head cartridge 7 ejects ink on the recording sheet in response to a signal from the carriage substrate, thereby forming an image.

(D) Paper Ejection Section

The paper ejection section 4 includes, for example, first and second paper ejecting rollers 40 and 41, spurs 42 configured to contact the first and second paper ejecting rollers 40 and 41 with a predetermined pressure so as to be rotationally driven by the first and second paper ejecting rollers 40 and 41, and a gear train (not shown) which transmits a driving force of the conveying roller 36 to the first and second paper ejecting rollers 40 and 41.

The first and second paper ejecting rollers 40 and 41 are attached to the platen 34. The first paper ejecting roller 40 is attached to a position on the upstream side with respect to the second paper ejecting roller 41 in the recording sheet conveying direction. A metal shaft of the first paper ejecting roller 40 is provided with a plurality of rubber portions (not shown). The first paper ejecting roller 40 is driven by a driving force of the conveying roller 36 through an idle gear. A resin shaft of the second paper ejecting roller 41 is provided with a plurality of elastic members (not shown) made of elastomer. The second paper ejecting roller 41 is driven by a driving force of the first paper ejecting roller 40 which is transmitted through an idle gear.

The spurs 42 each are formed such that a thin plate made of stainless steel and having a plurality of protrusions is integrally formed with a resin portion. The spurs 42 are attached to a spur holder 43. The spurs 42 are attached to the spur holder 43 via spur springs (not shown), each of which is a coil spring formed into a rod-like shape. The spurs 42 include one having a first function of mainly generating a conveying force of a recording sheet, and one having a second function of mainly preventing a recording sheet from flying when recording is performed on the recording sheet. The spur 42 having the first function is arranged at a position corresponding to a rubber portion of the first paper ejecting roller 40, and to the elastic members of the second paper ejecting roller 41. The spur 42 having the second function is arranged at a position not occupied by the rubber portion of the first paper ejection roller 40 or the elastic members of the second paper ejection roller 41. The spurs 42 are pressed to the first and second paper ejecting rollers 40 and 41 and the like by the spur springs.

With the above-described configuration, the recording sheet on which an image is formed by the carriage section 5 is conveyed while being nipped between the second paper ejecting roller 41 and the spur 42, and is ejected to a paper ejection tray 46. The paper ejection tray 46 is configured to be housed in a front cover 95. The paper ejection tray 46 is drawn out when it is used. The paper ejection tray 46 is formed such that its height increases toward the front end and its height at both side edges is higher than other portions. Accordingly, a stacking capability of the paper ejection tray 46 for ejected recording sheets increases. Also, a recording surface of a recording sheet ejected on the paper ejection tray 46 can be prevented from being rubbed.

(E) U-Turn Automatic Both-Side Conveyance Section

The U-turn automatic both-side conveyance section 8 (see FIG. 4) is arranged in a front portion of the recording apparatus 1, and has a cassette 81 in which recording sheets are housed. The cassette 81 includes a pressure plate 822 which causes stacked recording sheets to contact a paper feeding roller 821, so as to separate and feed a recording sheet. In addition to the cassette 81, the U-turn automatic both-side conveyance section 8 includes, for example, the paper feeding roller 821 which feeds a recording sheet, a separating roller 831 which separates a recording sheet, a return lever 824 which causes a recording sheet to return to a stacked position, and a pressing and control unit (not shown) for the pressure plate 822. These components are attached to a UT base 84 of a main body.

The cassette 81 can be used by two sizes—a normal size and a contracted size. The size is selected in accordance with a size of a recording sheet. When small-size recording sheets are used, or when the cassette 81 is not used, the cassette 81 is contracted, and housed in the cover section 9 of the main body.

The paper feeding roller 821 is formed into a rod-like shape having an arc cross section. A paper feeding roller rubber piece is provided near a sheet reference, and hence, a recording sheet is fed. A driving force is transmitted to the paper feeding roller 821 from a U-turn automatic both-side conveyance motor (not shown), which is provided at the U-turn automatic both-side conveyance section 8, via, for example, a transmission gear (not shown) and a planet gear (not shown).

The pressure plate 822 includes a movable side guide 827 which regulates a stacked position of recording sheets on the pressure plate 822. The pressure plate 822 is rotatable around a rotation shaft supported by the cassette 81. The pressure plate 822 is biased towards the paper feeding roller 821 by a pressing and control unit (not shown), which is, for example, a pressure plate spring (not shown) attached to the UT base 84. A separation sheet (not shown) is provided at a portion of the pressure plate 822, the portion facing the paper feeding roller 821. The separation sheet is made of a material having a large friction coefficient, and thus prevents double feeding of finally remaining, stacked recording sheets. The pressure plate 822 is configured to contact or be separated from the paper feeding roller 821 by the pressure plate cam.

Also, a separating roller holder (not shown) having the separating roller 831 is provided at the UT base 84. The separating roller 831 separates recording sheets one by one. The separating roller holder is rotatable around a rotation shaft supported by a separation base (not shown). The separating roller holder is biased towards the paper feeding roller 821 by a separating roller spring (not shown). A clutch spring (not shown) is attached to the separating roller 831. When a predetermined or higher load is applied to the clutch spring, a portion thereof to which the separating roller 831 is mounted can be rotated in a load application direction. The separating roller 831 is configured to contact or be separated from the paper feeding roller 821 by a separating roller release shaft (not shown) and a control cam (not shown). An ultrasonic (UT) sensor (not shown) detects the positions of the pressure plate 822, the return lever 824, and the separating roller 831.

Also, the return lever 824, which causes a recording sheet to return to the stacked position, is rotatably attached to the UT base 84. The return lever 824 is biased in a release direction by a return lever spring (not shown). When the recording sheet returns to the stacked position, the return lever 824 is rotated by the control cam.

In the standby state, the pressure plate 822 is released by the pressure plate cam, and the separating roller 831 is released by the control cam. At this time, the return lever 824 causes the recording sheet to return to the stacked position, and the return lever 824 is arranged at a position to close a stacking port so that the stacked recording sheets are not fed to the paper feeding roller 821.

When the operation of the U-turn automatic both-side conveyance section 8 is started, the U-turn automatic both-side conveyance motor is driven. Accordingly, the separating roller 831 contacts the paper feeding roller 821, the return lever 824 is released, and the pressure plate 822 contacts the paper feeding roller 821. In this state, feeding of a recording sheet is started. The number of recording sheets to be fed by a separation portion (not shown) is regulated. Recording sheets are fed to a nip portion which is defined by the paper feeding roller 821 and the separating roller 831. The recording sheets are separated at the nip portion, and hence, only a top recording sheet is conveyed by the paper feeding roller 821.

When the separated and conveyed recording sheet reaches a roller pair including a first U-turn intermediate roller 86 and a first U-turn pinch roller 861, which will be described later, the pressure plate 822 is released by the pressure plate cam, and the separating roller 831 is released by the control cam. The return lever 824 returns to the stacked position of the recording sheets by the control cam. The recording sheets separated at the nip portion, which is defined by the paper feeding roller 821 and the separating roller 831, return to the stacked position.

Two conveying rollers including the first U-turn intermediate roller 86 and a second U-turn intermediate roller 87 are provided downstream of the paper feed portion in the recording sheet conveying direction. The two rollers convey the fed and conveyed recording sheet. The two rollers each are formed such that rubber portions, which are made of ethylene-propylene-diene copolymer rubber (EPDM) with a rubber hardness ranging from 40 to 80 degrees, are provided at four to six positions of a core metal of a metal shaft. The first U-turn pinch roller 861 and a second U-turn pinch roller 871, which pinch a recording sheet, are supported by axle springs, and thus attached at positions corresponding to the rubber portions. The first and second U-turn pinch rollers 861 and 871 are respectively biased towards the first and second U-turn intermediate rollers 86 and 87. Also, an inner guide 881 defines an inner side of a conveyance path of a recording sheet, whereas an outer guide 882 defines an outer side of the conveyance path.

A flapper 883 defines a coupling portion of a paper feed path for a recording sheet between the above-described paper feed section 2 and U-turn automatic both-side conveyance section 8, so that a recording sheet conveyed from any of respective conveyance paths can be smoothly conveyed at the coupling portion. When a recording sheet is fed to the roller pair including the above-described conveying roller 36 and pinch rollers 37, and a front edge of the recording sheet contacts a nip of the roller pair including the conveying roller 36 and the pinch rollers 37, the automatic registration adjustment sensor is activated, and hence, an optimum registration adjustment value is obtained. The recording sheet on which an image is recorded is conveyed through the roller pair including the above-described conveying roller 36 and pinch rollers 37, and passes through the roller pair.

When automatic both-side recording is performed, in which an image is recorded on a first major surface, and subsequently, an image is also recorded on a second major surface, a rear edge of the recording sheet is fed again to the roller pair including the conveying roller 36 and the pinch rollers 37, and the roller pair is rotationally driven in reverse. Accordingly, the recording sheet is reversely conveyed. When the rear edge of the recording sheet is fed again to the roller pair including the conveying roller 36 and the pinch rollers 37, the pinch rollers 37 are being lifted by a lift mechanism 884, and a gap is being provided between the conveying roller 36 and the pinch rollers 37. Accordingly, the recording sheet is smoothly fed to the roller pair. After the rear edge of the recording sheet is fed, the pinch rollers 37 are lowered, and the pinch rollers 37 pinch the recording sheet against the conveying roller 36.

The recording sheet fed to the roller pair of the conveying roller 36 and the pinch rollers 37 passes through the roller pair, and enters again the conveyance path of the U-turn automatic both-side conveyance section 8. In the U-turn automatic both-side conveyance section 8, the recording sheet is pinched by a roller pair including a both-side roller 891 and a pinch roller 892. The recording sheet is conveyed by the roller pair, while being guided by a guide (not shown).

Then, the recording sheet is fed to the two conveying rollers including the first and second intermediate rollers 86 and 87, which reverse and convey the fed and conveyed recording sheet. When the recording sheet passes through the rollers, the recording sheet is reversed. The reversed recording sheet is fed to the roller pair including the conveying roller 36 and the pinch rollers 37. Then, an image is recorded on a back surface of the recording sheet. The recording sheet after having images recorded on both surfaces is conveyed through the roller pair including the above-described conveying roller 36 and pinch rollers 37, and passes through the roller pair.

(F) Recovery Section

The recovery section 6 includes, for example, a pump 60 which recovers the head cartridge 7, a cap 61 which prevents the head cartridge 7 from being dried, and a blade 62 which wipes a face of nozzles of the head cartridge 7.

The recovery section 6 is driven mainly when a driving force is transmitted from the above-described AP motor 273. The pump 60 is operated when the AP motor 273 is rotated in a first direction. The recovery section 6 has a one-way clutch (not shown). When the AP motor 273 is rotated in a second direction opposite to the first direction, in which the pump 60 is operated, the rotation of the AP motor 273 in the first direction, a driving force is transmitted and controlled so that the blade 62 is operated, that the cap 61 is lifted or lowered, and that valves (not shown) are opened or closed. With the one-way clutch, the valves are selectively opened or closed. Hence, ink of all colors can be simultaneously sucked by the suction pump 60, or ink of a single color can be individually sucked.

The pump 60 generates a negative pressure by squeezing two tubes (not shown) using a pump roller (not shown). The cap 61 and the pump 60 communicate with each other through, for example, a valve 66. When the pump 60 is operated in a state in which the cap 61 closely contacts the head cartridge 7, the pump 60 sucks unnecessary ink and other substances from the head cartridge 7. The cap 61 is provided with a cap absorber (not shown) to reduce an ink amount remaining on the face of the head cartridge 7 after sucking. The pump 60 sucks and removes the ink adhering to the cap 61 while the cap 61 is open, so as to prevent the ink absorbed by the cap absorber and remaining in the cap absorber from being fixed to the cap 61. The ink sucked by the pump 60 is absorbed and held by a waste ink absorber (not shown) provided at a lower case 99, which will be described later.

The series of operations including the operation of the blade 62 and the lifting or lowering operation of the cap 61 are controlled by a main cam (not shown) in which a plurality of cams are provided on a shaft. Cams and arms provided at the blade 62 and the cap 61 are operated by the main cam, thereby providing a predetermined operation. The position of the main cam can be detected by a position sensor (not shown) such as a photo interrupter. When the cap 61 is lowered, the blade 62 moves in a direction orthogonal to the scanning direction of the carriage section 5, and wipes the face of the head cartridge 7. The blade 62 is composed of a plurality of blades including a blade for wiping an area near the nozzle of the head cartridge 7, and a blade for wiping the entire face of the head cartridge 7. When the blade 62 moves to the deepest position, the blade 62 contacts a blade cleaner (not shown). Then, ink and other substance adhering to the blade 62 are removed.

(G) Cover Section

The cover section 9 includes, for example, the lower case 99, an upper case 98, an access cover 97, a connector cover (not shown), the front cover 95, and a side cover (not shown). The sections described above are assembled with the chassis 11 and form the mechanical unit of the recording apparatus 1. The cover section 9 is provided to surround the periphery of the mechanical unit.

The front cover 95 includes the paper ejection tray 46 which can be housed to close a paper ejection port when it is not used. A sensor can detect whether the front cover 95 is open or closed.

The access cover 97 is rotatably provided at the upper case 98. An opening is formed in an upper surface of the upper case 98. An ink tank 71 and the head cartridge 7 can be replaced through the opening. The upper case 98 includes, for example, a door switch lever (not shown) which detects whether the access cover 97 is open or closed, an LED guide (not shown) which transmits light of an LED for display, and a key switch 983 which acts on a switch of a substrate. Also, the paper feed tray 26 is attached to the upper case 98. The paper feed tray 26 may be housed through rotation when it is not used. The paper feed tray 26 also serves as a cover of the paper feed section 2 in a housed state.

The upper case 98 and the lower case 99 are attached by fitting pawls having elasticity. A connector portion therebetween is covered with a connector cover (not shown). Side covers (not shown) are attached to cover the upper case 98 and the lower case 99 from the left and right sides.

Next, the detail of the carriage section 5 of the recording apparatus 1 according to this embodiment is described.

Figure 6:
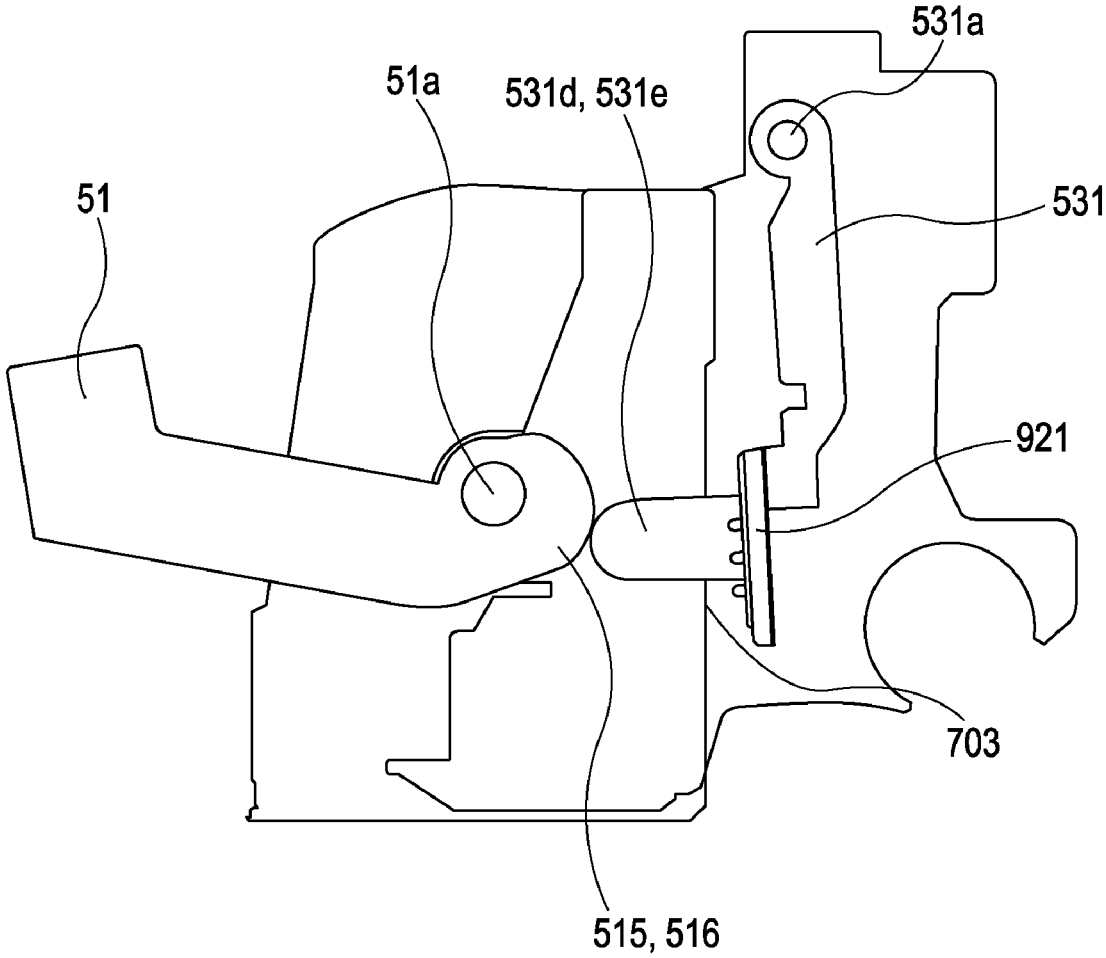
FIG. 6 is a cross-sectional view showing the carriage section of the recording apparatus shown in, for example, FIG. 1.
Figure 7A:
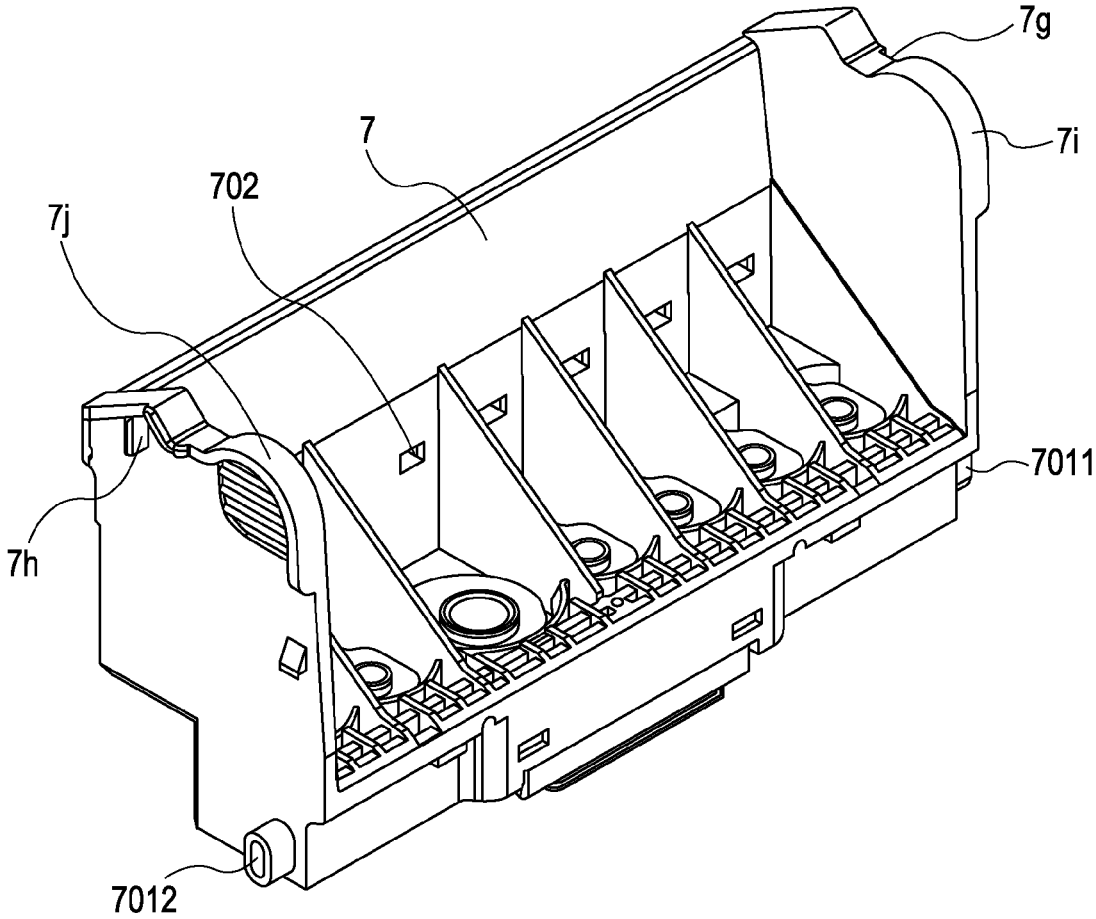
FIG. 7A is a perspective view showing an ink cartridge of the recording apparatus shown in, for example, FIG. 1.
Figure 7B:
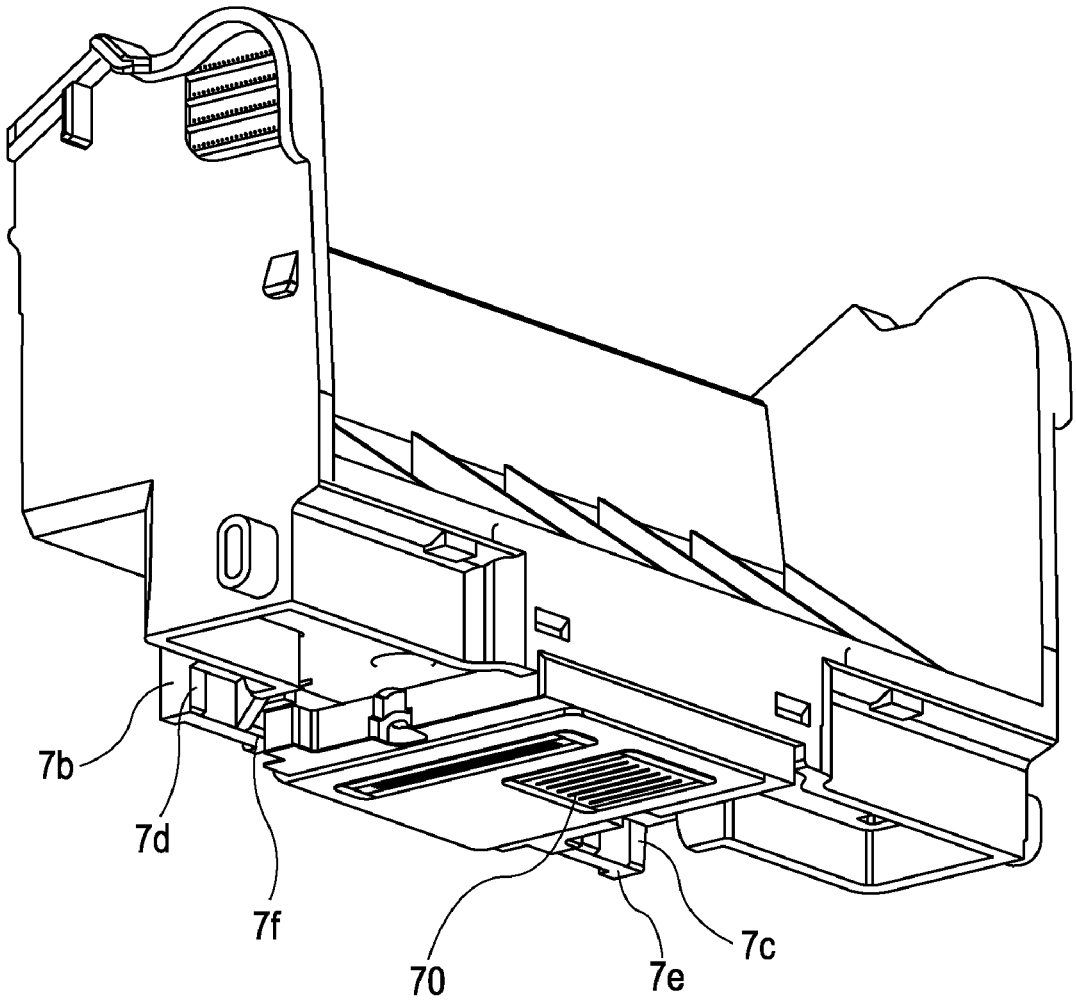
FIG. 7B is a perspective view showing the ink cartridge of the recording apparatus shown in, for example, FIG. 1.
Figure 7C:
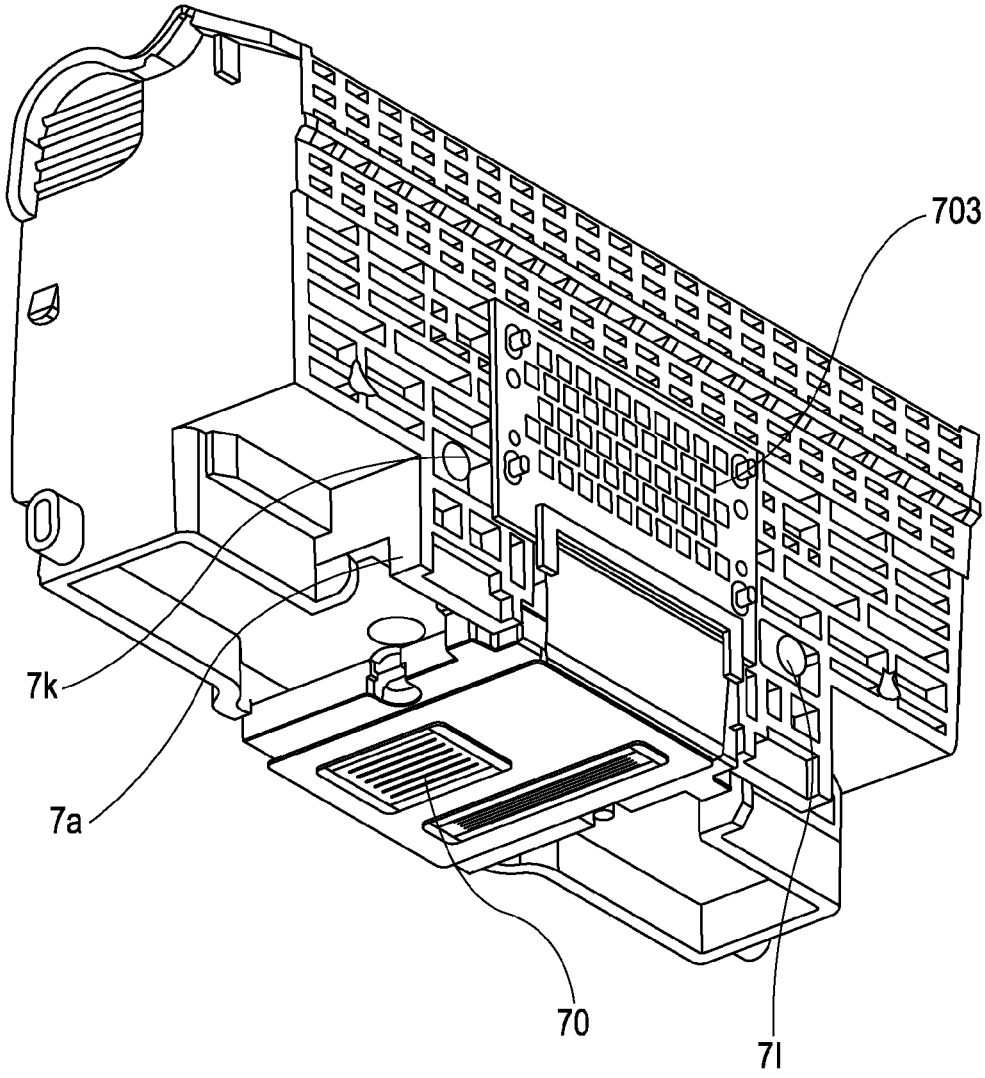
FIG. 7C is a perspective view showing the ink cartridge of the recording apparatus shown in, for example, FIG. 1.
Figure 8:
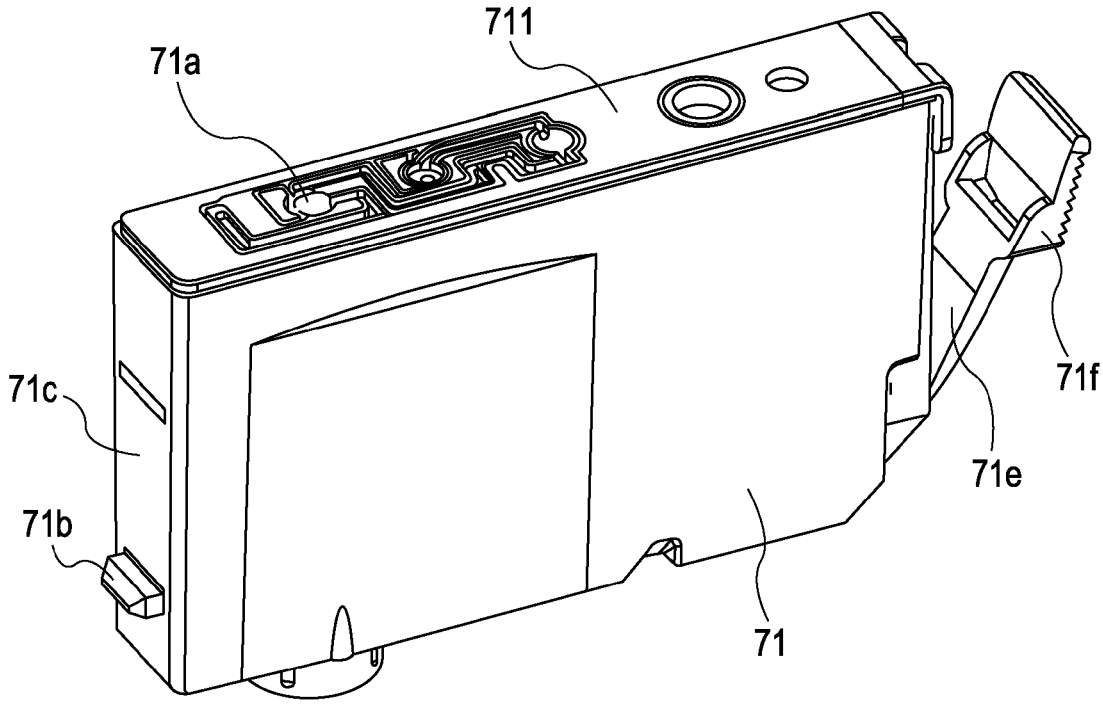
FIG. 8 is a perspective view showing an ink tank of the recording apparatus shown in, for example, FIG. 1.

FIGS. 5A, 9, 10, 12, 13 are perspective views each showing the carriage section 5 of the recording apparatus 1 according to this embodiment. FIG. 5B is a top view of the carriage section 5. FIGS. 6 and 11 are cross-sectional views of the carriage section 5. FIGS. 7A, 7B, and 7C are perspective views each showing the head cartridge 7 of the recording apparatus 1 according to this embodiment. FIG. 8 is a perspective view showing the ink tank 71 of the recording apparatus 1 according to this embodiment.

For convenience of the description, it is assumed that an X direction represents the main-scanning direction, a Y direction represents the sub-scanning direction, and a Z direction represents a vertical direction, as shown in FIG. 1.

Figure 10:
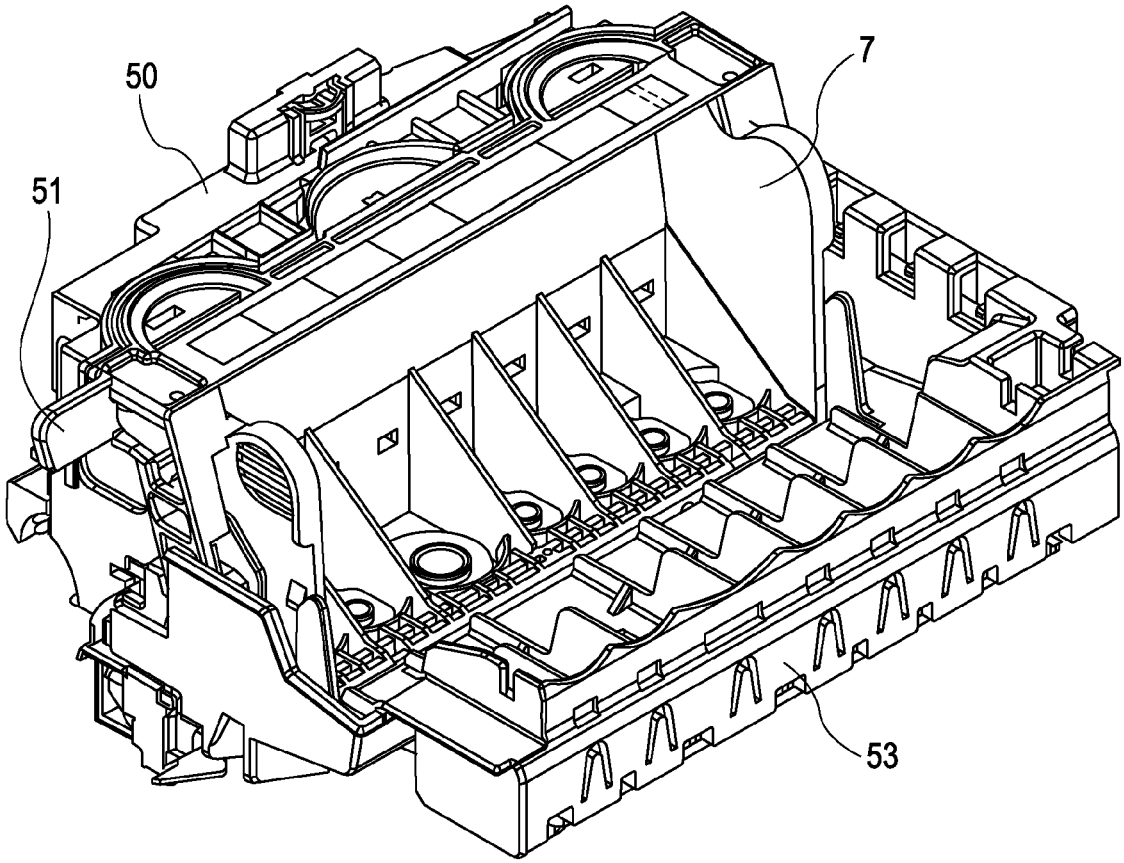
FIG. 10 is a perspective view showing the carriage section of the recording apparatus shown in, for example, FIG. 1.
Figure 11:
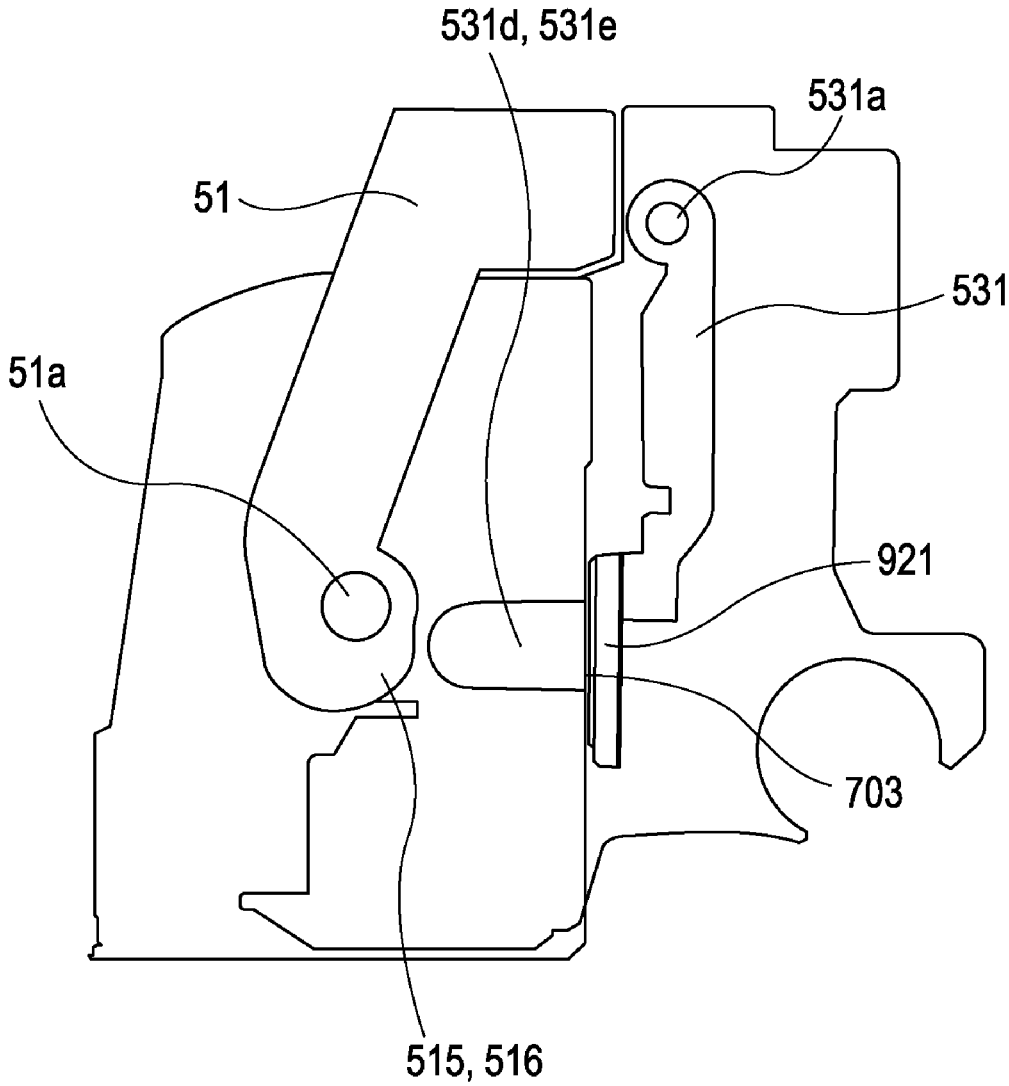
FIG. 11 is a cross-sectional view showing the carriage section of the recording apparatus shown in, for example, FIG. 1.

Referring to FIG. 10, the carriage section 5 includes the carriage 50, a carriage cover 53, and a head set lever (lever member) 51 serving as a fixing unit which removably mount the head cartridge 7 on the carriage 50. Also, referring to FIG.

6, the carriage 50 has a swing cover 531. The swing cover 531 includes a contact 921 of the carriage 50. The contact 921 serves as a second electric contact portion of the carriage 50. The contact 921 is configured to be electrically connected to a contact surface 703 (see FIG. 7C) of the head cartridge 7. The contact surface 703 serves as a first electric contact portion.

Figure 5A:
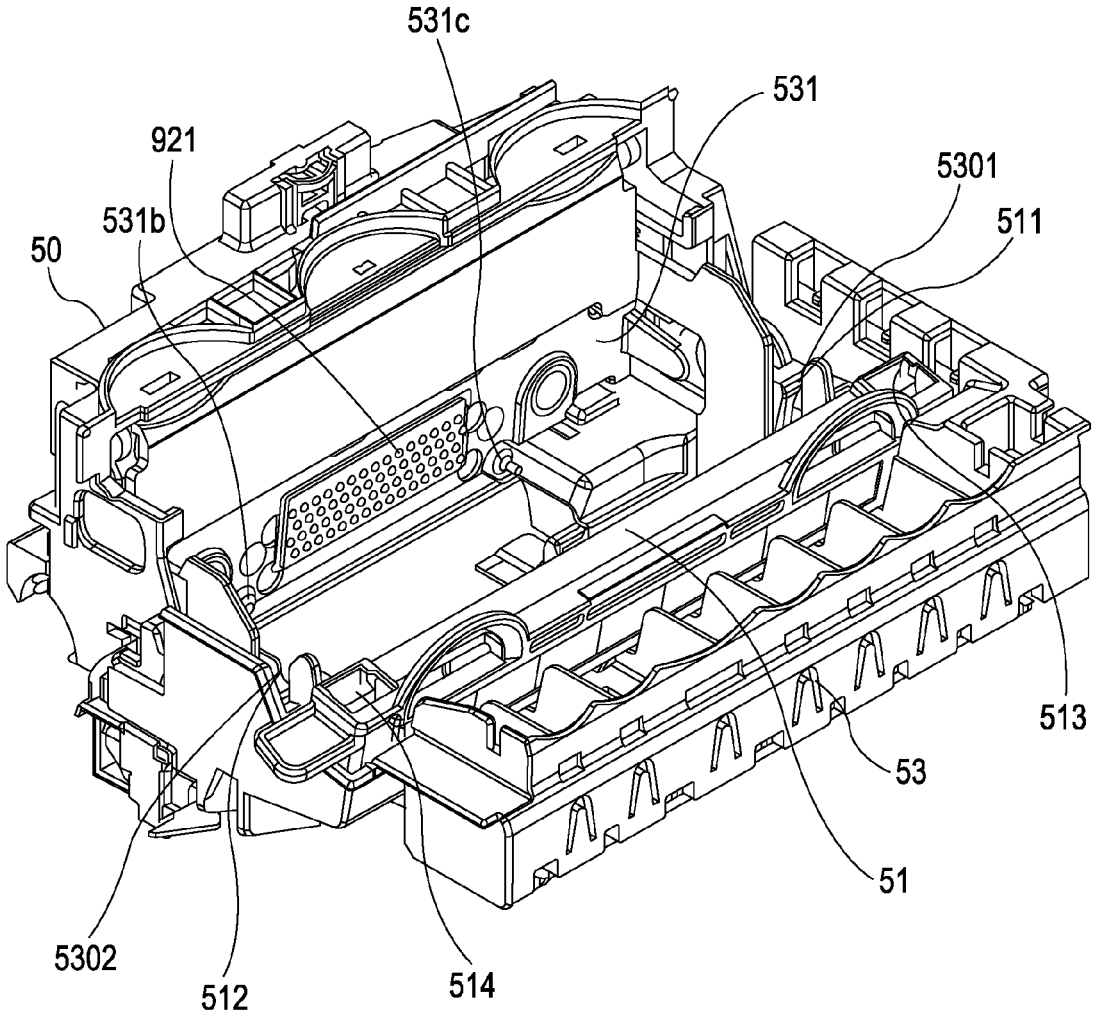
FIG. 5A is a perspective view showing a carriage section of the recording apparatus shown in, for example, FIG. 1.
Figure 5B:
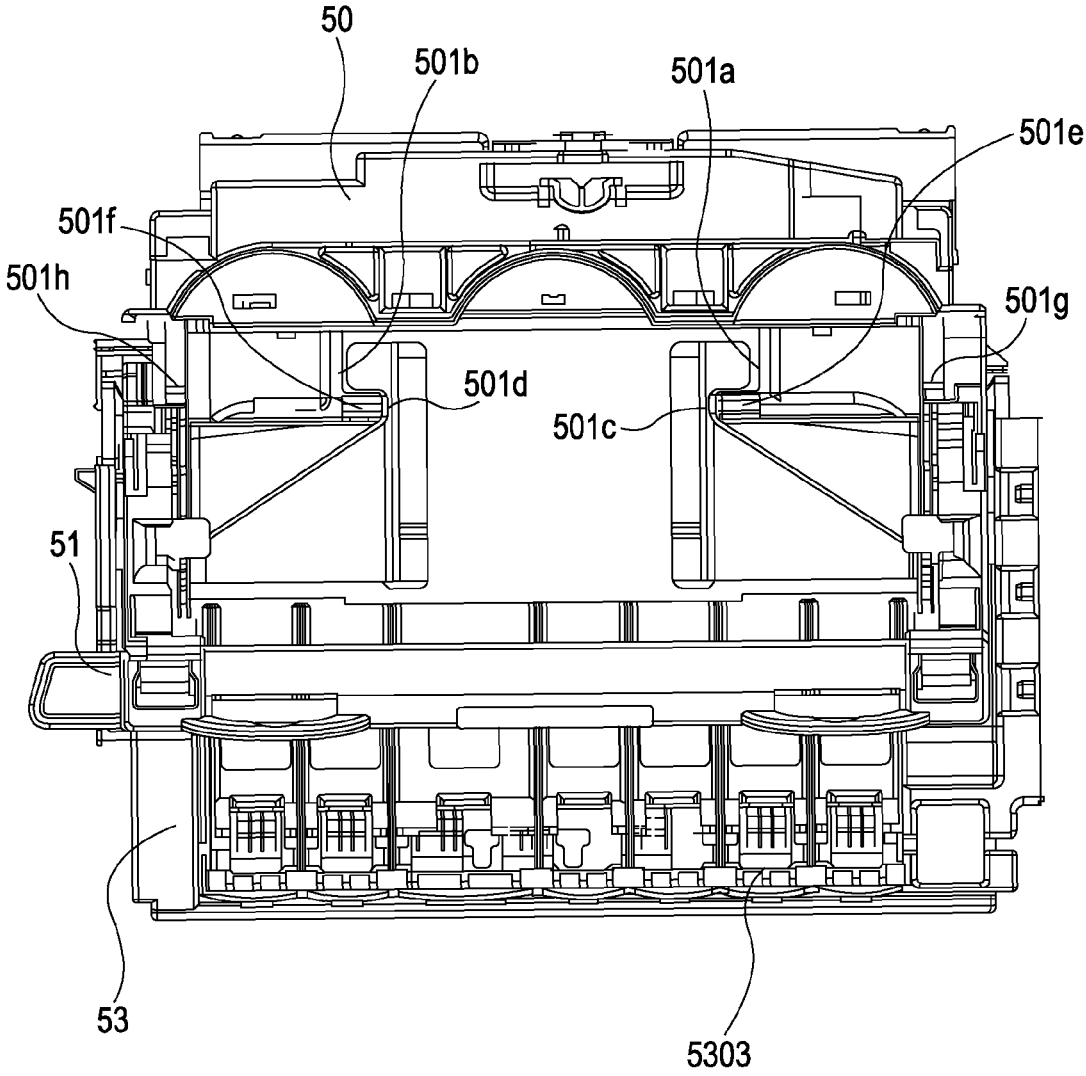
FIG. 5B is a top view showing the carriage section of the recording apparatus shown in, for example, FIG. 1.

Referring to FIG. 5A, the carriage cover 53 has guide grooves 5301 and 5302 which guide the head cartridge 7 when the head cartridge 7 is mounted on the carriage 50, and an engagement hole 5303 (shown in FIG. 5B) for fixing the ink tank 71. Also, referring to FIG. 5B, the carriage 50 has an abutment surface for positioning the head cartridge 7. In particular, the carriage 50 includes X-direction abutment surfaces 501*a* and 501*b*, Y-direction abutment surfaces 501*c* and 501*d*, Z-direction abutment surfaces 501*e* and 501*f*, an X-axis-rotation abutment surface 501*g*, and a Z-axis-rotation abutment surface 501*h*.

Referring to FIGS. 6 and 11, the head set lever 51 is movable when the head set lever 51 is rotated around a rotation shaft 51*a*. Eccentric cams 515 and 516 are provided at both end portions of the rotation shaft 51*a*. Referring to FIG. 5A, the head set lever 51 also has a pressing portion which presses the head cartridge 7 to the carriage 50. The pressing portion is formed of two head pressing springs 513 and 514.

Referring to FIGS. 6 and 11, the swing cover 531 is arranged at a position facing a back surface of the head cartridge 7 when the head cartridge 7 is mounted on the carriage 50. The swing cover 531 has a rotation shaft 531*a*, which is parallel to the rotation shaft 51*a* of the head set lever 51, at an upper portion of the swing cover 531. The swing cover 531 is rotatable around the rotation shaft 531*a*. When the swing cover 531 receives a torque in a clockwise direction in FIG. 6 around the rotation shaft 51*a* by a pressing portion (not shown), the contact 921 is pressed toward the contact surface 703. Protrusions 531*d* and 531*e* are formed at both end portions on a surface of the contact 921 of the swing cover 531, at positions corresponding to the eccentric cams 515 and 516 of the head set lever 51.

Referring to FIG. 7A, the head cartridge 7 has guide shafts 7011 and 7012 which guide insertion of the head cartridge 7 into the carriage 50. Also, the head cartridge 7 has cam surfaces 7*i* and 7*j* at the upper portion of the head cartridge 7. The cam surfaces 7*i* and 7*j* are fixed by the head set lever 51.

As shown in FIGS. 7A and 7B, the head cartridge 7 includes X-direction abutment surfaces 7*a* and 7*b*, Y-direction abutment surfaces 7*c* and 7*d*, Z-direction abutment surfaces 7*e* and 7*f*, an X-axis-rotation abutment surface 7*g*, and a Z-axis-rotation abutment surface 7*h*.

The contact surface 703 shown in FIG. 7C is connected to a heater board (not shown) which is provided near a nozzle 70. While the head cartridge 7 is mounted on the carriage 50, the contact 921 of the swing cover 531 is pressed to the contact surface 703 by the pressing portion. Accordingly, the contact surface 703 is electrically connected to the carriage substrate via the contact 921, and hence, transmitting and receiving of an electric signal is permitted.

Referring to FIG. 8, the ink tank 71 has an upper cover 711 which covers and seals an upper portion of a container space for ink. The upper cover 711 has an air communication port 71*a*. Also, a retaining pawl 71*b* is formed at a surface 71*c* located at one side of the ink tank 71. The retaining pawl 71*b* can be engaged with a retaining hole 702 of the head cartridge 7 shown in FIG. 7A. An elastically deformable latch lever 71*e* is integrally formed at a surface located at another side of the ink tank 71. A latch pawl 71*f* is formed at the latch lever 71*e*. The latch pawl 71*f* can be engaged with the engagement hole 5303 of the carriage cover 53 shown in FIG. 5B. With this configuration, the ink tank 71 is fixed to the head cartridge 7.

Next, a mounting operation of the head cartridge 7 on the carriage 50 of the recording apparatus 1 according to this embodiment is described.

For convenience of the description, it is assumed that a "first position" represents a position of the head set lever 51 while the head set lever 51 fixes the head cartridge 7. Also, it is assumed that a "second position" represents a position of the head set lever 51 while the head set lever 51 is released and thus mounting and removal of the head cartridge 7 on and from the carriage 50 is permitted.

FIG. 5A shows the carriage section 5 when the head set lever 51 is at the second position. Guide grooves 511 and 512 provided at the head set lever 51 for guiding the head cartridge 7, and the guide grooves 5301 and 5302 of the carriage cover 53 are released in this state.

Figure 9:
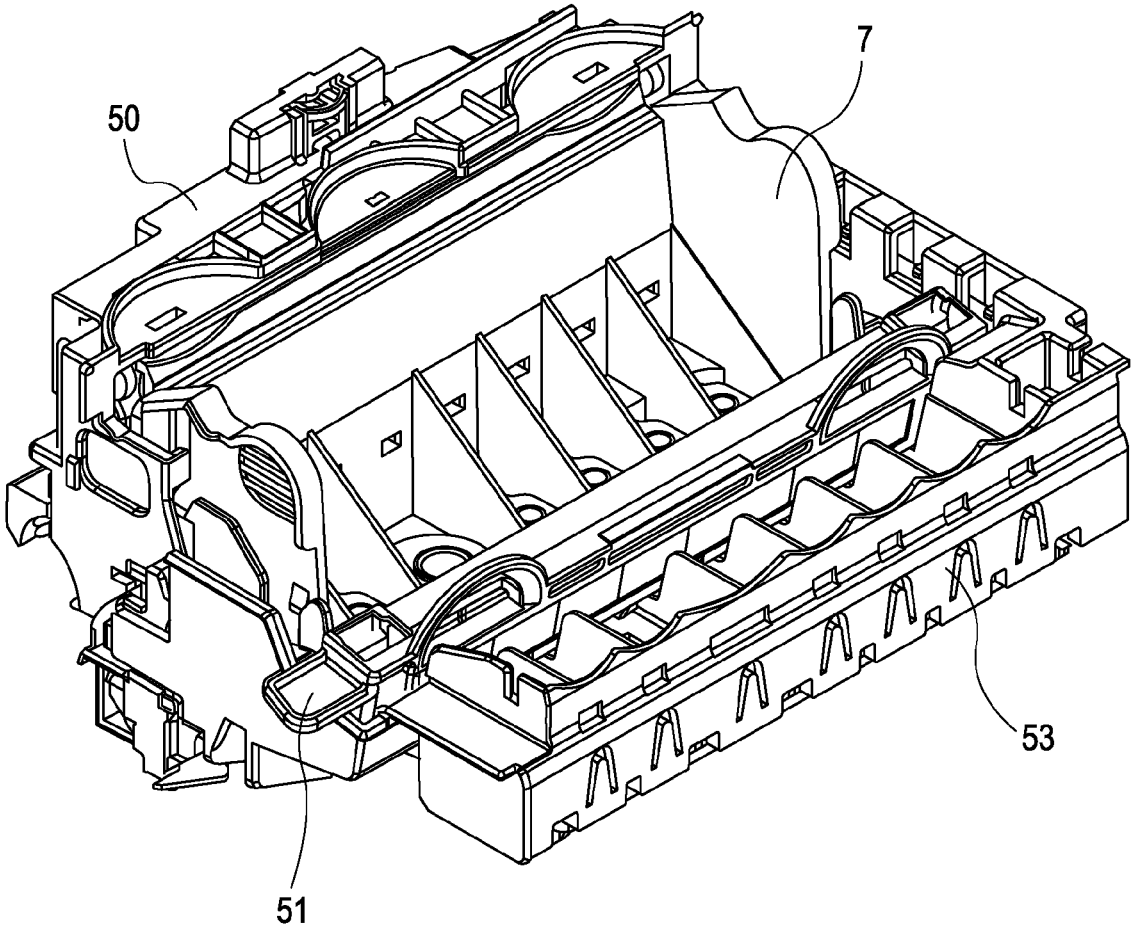
FIG. 9 is a perspective view showing the carriage section of the recording apparatus shown in, for example, FIG. 1.

First, the guide shafts 7011 and 7012 of the head cartridge 7 shown in FIG. 7A are substantially vertically inserted to the carriage 50 along the guide grooves 511 and 512 of the head set lever 51 and along the guide grooves 5301 and 5302 of the carriage cover 53. FIG. 9 illustrates this state.

Then, the head set lever 51 is rotated upward, and the head set lever 51 is arranged at the first position so as to contact the upper surface of the head cartridge 7. Thus, the mounting of the head cartridge 7 to the carriage 50 is completed. FIG. 10 illustrates this state.

At this time, the head pressing springs 513 and 514 of the head set lever 51 shown in FIG. 5A contact the cam surfaces 7*i* and 7*j* of the head cartridge 7 shown in FIG. 7A. Thus, the head cartridge 7 is pressed in the Z direction. Then, the abutment surfaces 7*e* and 7*f* of the head cartridge 7 contact the abutment surfaces 501*e* and 501*f* of the carriage 50. Thus, the head cartridge 7 is positioned in the Z direction. Also, the abutment surfaces 7*a* and 7*b* of the head cartridge 7 contact the abutment surfaces 501*a* and 501*b* of the carriage 50. Thus, the head cartridge 7 is positioned in the X direction. Also, the abutment surfaces 7*c* and 7*d* of the head cartridge 7 contact the abutment surfaces 501*c* and 501*d* of the carriage 50. Thus, the head cartridge 7 is positioned in the Y direction. Further, the abutment surfaces 7*g* and 7*h* of the head cartridge 7 contact the abutment surfaces 501*g* and 501*h* of the carriage 50. Thus, the head cartridge 7 is positioned in the directions around the X and Z axes.

FIG. 6 illustrates a state in which although the head cartridge 7 is inserted into the carriage 50, the head set lever 51 is arranged at the second position, and the head cartridge 7 is not fixed by the head set lever 51. In this state, the eccentric cams 515 and 516 of the head set lever 51 contact the protrusions 531*d* and 531*e* of the swing cover 531. At this time, when the protrusions 531*d* and 531*e* of the swing cover 531 are pressed by the eccentric cams 515 and 516 to move away from the head cartridge 7, the contact 921 is separated from the contact surface 703.

A cross section, which extends perpendicularly to the rotation shaft 51*a*, of each of the eccentric cams 515 and 516 of the head set lever 51 is formed such that a radial length from the rotation shaft 51*a* toward the contact surface 703 decreases as the head set lever 51 is rotated upward. Accordingly, when the head set lever 51 is rotated upward, the swing cover 531 moves synchronously with the rotation of the head set lever 51 while the protrusions 531*d* and 531*e* contact the eccentric cams 515 and 516 by the pressing portion. That is, the contact 921 of the head set lever 51 moves toward the contact surface 703 by a distance corresponding to a decrease amount of the radial length of each of the eccentric cams 515 and 516. Then, the swing cover 531 is separated from the eccentric cams 515 and 516. At this time, the contact 921 is pressed to the contact surface 703 by the pressing portion.

The contact 921 is formed of a plurality of electrically conductive resilient or elastic members. When the contact 921 is elastically deformed, the contact 921 is biased towards the contact surface 703 as a result of the elastic recovery force of the contact 921. A pressing force of the pressing portion of the swing cover 531 is larger than a biasing force of the contact 921. Hence, an electrical connection can be reliably established between the contact 921 and the contact surface 703 by the biasing force of the contact 921 while the contact 921 contacts the contact surface 703. FIG. 11 illustrates this state.

Next, an attachment operation of the ink tank 71 to the head cartridge 7 of the recording apparatus 1 according to this embodiment is described.

FIG. 10 illustrates a state in which the head cartridge 7 is inserted to the carriage 50 and the head set lever 51 is arranged at the first position. At this time, the head cartridge 7 is being fixed by the head set lever 51, and the mounting operation of the head cartridge 7 has been completed. In this state, the ink tank 71 is attached to the head cartridge 7.

Figure 13:
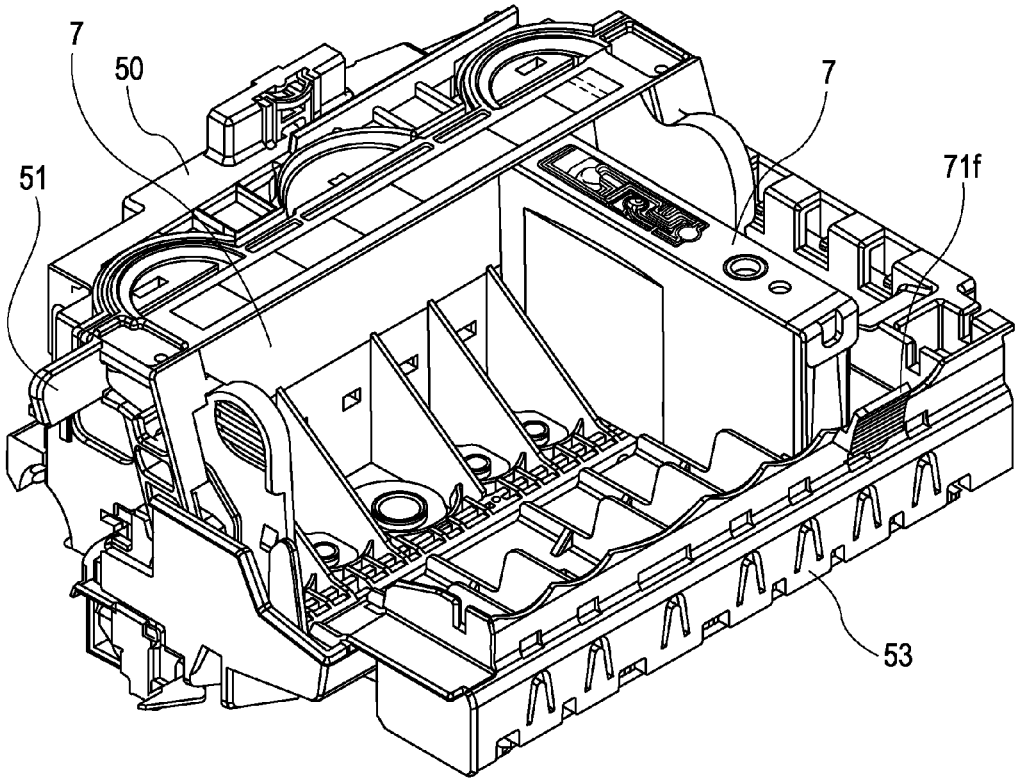
FIG. 13 is a perspective view showing the carriage section of the recording apparatus shown in, for example, FIG. 1.

When the ink tank 71 is to be attached to the head cartridge 7, first, the retaining pawl 71*b* formed at the ink tank 71 shown in FIG. 8 is engaged with the retaining hole 702 of the head cartridge 7. Then, the latch pawl 71*f* of the latch lever 71*e* of the ink tank 71 is engaged with the engagement hole 5303 of the carriage cover 53 shown in FIG. 5B. Accordingly, the ink tank 71 is fixed to the head cartridge 7, and the attachment operation is completed. FIG. 13 illustrates this state. Similarly to the above attachment operation, a predetermined number of ink tanks 71 are mounted.

As described above, the head cartridge 7 and the ink tank 71 can be mounted on the carriage 50 when the operation procedure is correct.

Figure 12:
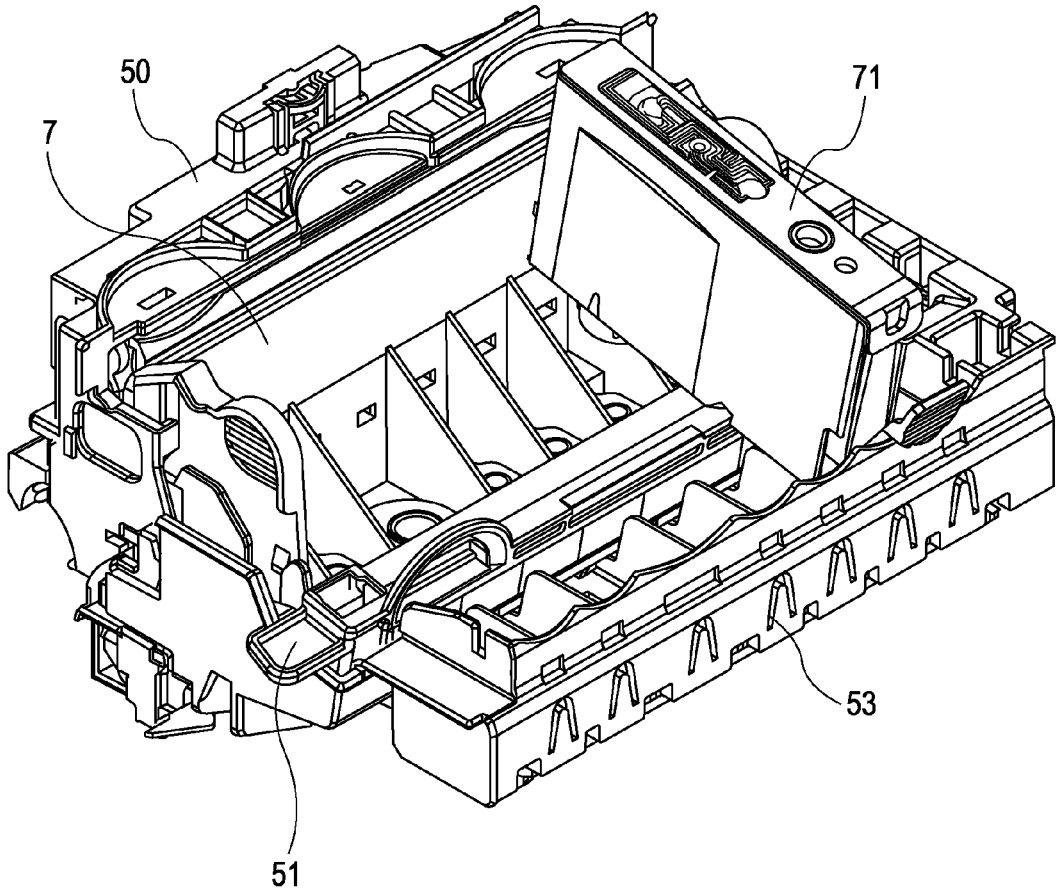
FIG. 12 is a perspective view showing the carriage section of the recording apparatus shown in, for example, FIG. 1.

FIG. 9 illustrates a state in which although the head cartridge 7 is inserted into the carriage 50, the head set lever 51 is arranged at a position other than the first position, and the head cartridge 7 is not fixed by the head set lever 51. Even if the ink tank 71 is tried to be mounted on the head cartridge 7 in this state, as shown in FIG. 12, the head set lever 51 blocks a part of an attachment path in which the ink tank 71 is inserted into the head cartridge 7, and inhibits the insertion of the ink tank 71. Hence, the ink tank 71 cannot be attached to the head cartridge 7.

As described above, with the recording apparatus 1 according to this embodiment, in a state in which the head cartridge 7 is not fixed to the carriage 50 by the head set lever 51, the head set lever 51 inhibits the attachment of the ink tank 71, and hence, the ink tank 71 cannot be attached. Thus, a user can be prevented from incorrectly performing the operation procedure of mounting the head cartridge 7 and the ink tank 71 on the carriage 50.

Further, referring to FIG. 11, the electrical connection is established between the contact 921 and the contact surface 703 only when the head cartridge 7 is correctly fixed by the arrangement of the head set lever 51 at the first position. At this time, the carriage 50 is electrically connected to the head cartridge 7. In contrast, as shown in FIG. 6, in the state in which the head set lever 51 is arranged at a position other than the first position, and the head cartridge 7 is not fixed by the head set lever 51, the electrical connection is not established between the contact 921 and the contact surface 703. At this time, the carriage 50 is not electrically connected to the head cartridge 7. In particular, when the head cartridge 7 is not correctly fixed, transmitting and receiving of an electric signal are not permitted between the carriage 50 and the head cartridge 7. Even when the ink tank 71 is attached to the head cartridge 7 in this state, the recording head of the head cartridge 7 is not operated. Accordingly, the user may be aware that the head cartridge 7 is defectively fixed. The user can mount the head cartridge 7 and the ink tank 71 by the correct operation procedure.

Next, a detachment operation of the ink tank 71 from the head cartridge 7 of the recording apparatus 1 according to this embodiment is described.

To detach the ink tank 71 in the state in which the ink tank 71 is attached to the carriage 50 as shown in FIG. 13, first, the latch lever 71*e* shown in FIG. 8 is pushed, so that the latch pawl 71*f* is disengaged from the engagement hole 5303 of the carriage cover 53. Then, the latch lever 71*e* is pushed up, and accordingly, the ink tank 71 is detached from the head cartridge 7. Similarly to the above detachment operation, a predetermined number of ink tanks are detached from the head cartridge 7.

Next, a removing operation of the head cartridge 7 from the carriage 50 of the recording apparatus 1 according to this embodiment is described.

Referring to FIG. 10, to remove the head cartridge 7 from the carriage 50 in the state in which the ink tank 71 is not attached, first, the head set lever 51 located at the first position is rotated downward, to the second position. At this time, the guide grooves 511 and 512 of the head set lever 51 and the guide grooves 5301 and 5302 of the carriage cover 53 shown in FIG. 5B obtain opening widths which allow the guide shafts 7011 and 7012 of the head cartridge 7 shown in FIG. 7A to pass therethrough. FIG. 9 illustrates this state. In this state, the head cartridge 7 is removed when the head cartridge 7 is pulled up.

The second position of the head set lever 51 may be a position at which the head set lever 51 has been rotated to the lowermost position. However, the second position may be an intermediate position in a rotation path of the head set lever 51 as long as the ink tank 71 can be detached.

When the head set lever 51 is located at an intermediate position in a movement path between the first and second positions, the guide grooves 511, 512, 5301, and 5302 have opening widths smaller than the width of the guide shafts 7011 and 7012. Hence, the head cartridge 7 cannot be removed from the carriage 50.

FIG. 13 illustrates the state in which the ink tank 71 is attached to the head cartridge 7. In this state, the ink tank 71 is present in an operation path in which the head set lever 51 located at the first position is pushed down, and hence, the ink tank 71 inhibits the rotation of the head set lever 51. As described above, in the state in which the ink tank 71 is mounted, the head set lever 51 cannot be operated to the second position at which the head cartridge 7 is removable. Thus, the head cartridge 7 cannot be removed from the carriage 50.

Also, as shown in FIG. 11, in the rotation process of the head set lever 51 from the first position to the second position, first, the eccentric cams 515 and 516 of the head set lever 51 contact the protrusions 531*d* and 531*e* of the swing cover 531. Accordingly, when the head set lever 51 is further rotated downward, the swing cover 531 moves synchronously with the rotation of the head set lever 51 while the protrusions 531*d* and 531*e* contact the eccentric cams 515 and 516 by the pressing portion. That is, the contact 921 of the head set lever 51 moves away from the contact surface 703 by a distance corresponding to an increase amount of the radial length of each of the eccentric cams 515 and 516. Hence, the contact 921 is separated from the contact surface 703. FIG. 6 illustrates this state.

As described above, with the recording apparatus 1 according to this embodiment, the contact 921 returns to the position at which the contact 921 is separated from the contact surface 703 every removing operation of the head cartridge 7. Thus, the user can be prevented from incorrectly performing the operation procedure of mounting the head cartridge 7 and the ink tank 71 on the carriage 50, in each operation.

MODIFICATIONS

The configuration illustrated in the above-described embodiment is a merely exemplary configuration, and the present invention is not limited thereto.

For example, concerning a portion, which inhibits the ink tank from being mounted on the carriage while the head cartridge is not fixed to the carriage, the portion is not limited to the configuration using the lever for fixing the head cartridge to the carriage, and may be any configuration as long as an inhibition effect can be obtained.

According to this embodiment of the present invention, the recording apparatus is provided, which is capable of preventing the user from defectively mounting the head cartridge and the ink tank on the carriage as a result of the incorrect procedure.

While the present invention has been described with reference to exemplary embodiments, it is to be understood that the invention is not limited to the disclosed exemplary embodiments. The scope of the following claims is to be accorded the broadest interpretation so as to encompass all equivalent structures and functions.

This application claims the benefit of Japanese Application No. 2007-308589 filed Nov. 29, 2007, which is hereby incorporated by reference herein in its entirety.

What is claimed is:

1. A recording apparatus comprising:

an ink tank configured to contain ink;

a head cartridge, the ink tank being detachably attached to the head cartridge;

a carriage being configured to removably mount the head cartridge thereon;

a fixing unit configured to fix the head cartridge to the carriage, the fixing unit being movable between a first position at which the head cartridge is fixed to the carriage and a second position at which mounting and removal of the head cartridge on and from the carriage is permitted, wherein the attachment of the ink tank to the head cartridge is inhibited when the head cartridge is mounted on the carriage and the fixing unit is arranged at a position other than the first position.

2. The recording apparatus according to claim 1, wherein the attachment of the ink tank to the head cartridge is inhibited when the head cartridge is mounted on the carriage and the fixing unit is arranged at the position other than the first position, because a portion of the fixing unit is located within an attachment locus in which the ink tank is attached to the head cartridge.

3. The recording apparatus according to claim 1, wherein movement of the fixing unit from the first position to the second position is inhibited when the head cartridge is mounted on the carriage and the ink tank is mounted on the head cartridge.

4. The recording apparatus according to claim 3, wherein the movement of the fixing unit is inhibited when the head cartridge is mounted on the carriage and the ink tank is mounted on the head cartridge, because a portion of the ink tank is arranged within a movement locus in which the fixing unit moves from the first position to the second position.

5. The recording apparatus according to claim 1, wherein the fixing unit is rotatable between the first position and the second position around a rotation shaft, and the fixing unit comprises a lever member including a pressing portion configured to press the head cartridge to the carriage.

6. The recording apparatus according to claim 1, wherein the head cartridge has a first electric contact portion, and the carriage has a second electric contact portion configured to be electrically connected to the first electric contact portion, and wherein, while the head cartridge is mounted on the carriage, the first electric contact portion is electrically connected to the second electric contact portion when the fixing unit is arranged at the first position, and the first electric contact portion is not electrically connected to the second electric contact portion when the fixing unit is arranged at the second position.

7. The recording apparatus according to claim 6, wherein the second electric contact portion is arranged at a position at which the second electric contact portion contacts and is electrically connected to the first electric contact portion when the fixing unit is arranged at the first position, and the second electric contact portion is separated from the first electric contact portion when the fixing unit moves from the first position toward the second position.

* * * * *